US008475991B2

(12) United States Patent
Fujita et al.

(10) Patent No.: US 8,475,991 B2
(45) Date of Patent: Jul. 2, 2013

(54) TRANSPARENT TONER AND IMAGE FORMING METHOD

(75) Inventors: Michiyo Fujita, Tokyo (JP); Tatsuya Nagase, Tokyo (JP); Asao Matsushima, Tokyo (JP); Yasuko Uchino, Tokyo (JP); Aya Shirai, Tokyo (JP); Ryuichi Hiramoto, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 268 days.

(21) Appl. No.: 12/948,917

(22) Filed: Nov. 18, 2010

(65) Prior Publication Data

US 2011/0129771 A1 Jun. 2, 2011

(30) Foreign Application Priority Data

Dec. 1, 2009 (JP) ..... 2009-273302

(51) Int. Cl.
*G03G 13/20* (2006.01)

(52) U.S. Cl.
USPC ..... 430/124.3; 399/320

(58) Field of Classification Search
USPC ..... 399/320; 430/124.3
See application file for complete search history.

(56) References Cited

U.S. PATENT DOCUMENTS

| | | | | |
|---|---|---|---|---|
| 4,265,993 | A * | 5/1981 | Kawanishi et al. | 430/109.3 |
| 2007/0048653 | A1 * | 3/2007 | Ide | 430/120 |

FOREIGN PATENT DOCUMENTS

| | | |
|---|---|---|
| JP | 11007174 | 1/1999 |
| JP | 2002341619 | 11/2002 |
| JP | 2004258537 | 9/2004 |
| JP | 2007140037 | 6/2007 |
| JP | 2007314608 | 12/2007 |
| JP | 2009073942 | 4/2009 |

* cited by examiner

*Primary Examiner* — Hoa V Le
(74) *Attorney, Agent, or Firm* — Lucas & Mercanti, LLP

(57) ABSTRACT

A transparent toner for forming a glossy surface is disclosed, wherein a critical surface tension of a glossy surface formed by the transparent toner at 20° C. is at least 50 mN/m, and the transparent toner comprises a resin composed of a polymer formed by employing at least a polymerizable monomer containing a carboxylic group (—COOH). An image forming method employing the transparent tone is also disclosed.

4 Claims, 1 Drawing Sheet

TRANSPARENT TONER AND IMAGE FORMING METHOD

This application is based on Japanese Patent Application No. 2009-273302 filed on Dec. 1, 2009, in Japanese Patent Office, the entire content of which is hereby incorporated by reference.

TECHNICAL FIELD

The present invention relates to a colorless toner so called as transparent toner for providing gloss onto an image formed by a known printing method such as an electrophotographic method or an ink-jet method, and in particular it relates to a transparent toner which makes the fingerprint less visible on the formed image.

BACKGROUND

Recently, the printed image typified by photographic image and poster is formed by an ink-jet apparatus or an electrophotographic image forming apparatus additionally to usual silver halide photographic system and gravure printing method.

For instance, formation of an fine dot image on a level of 1,200 dpi (dpi: dot number per inch (2.54 cm)) is made possible in the field of the image forming technology of electrophotography such as copying machine or printer accompanied with the progress in the technology such as digitalization of exposing system and minimizing of the toner diameter. Moreover, a technology capable of forming a full color image is developed in which toner images are respectively formed on plural photoreceptor drums and the formed toner images are piled by primarily transferred onto an intermediate transferring member, and the image formed on the intermediate transferring member is secondarily transferred onto image support material. As above-mentioned, the formation of full color image requiring high resolving power such as that of the photographic image can be realized by such the image forming method additionally to the usual silver halide photography or printing technology.

A glossy image is often required in a photographic image of poster; however, white background area with low glossiness of the image formed by the toner is obtained sometimes even though the images area fixed on the support such as a paper sheet has some degree of glossiness. Such the unbalance in the glossiness in the finished image causes degradation in the image quality of the printed matter; therefore countermeasure to such the phenomenon is demanded.

On such the background, a technique is investigated, by which the image formation is carried out by using a toner constituted by omitting colorant from the usual color toner, so called as a transparent toner or clear toner, for preventing the formation of irregularity in the glossiness on the image. In concrete, a technique is disclosed, in which the transparent toner is uniformly provided on the whole surface of the support carrying the image and heated and cooled to form a transparent toner layer on the whole surface of the image for preparing a printed matter having uniform glossiness on the whole surface of the image; cf. Patent Document 41, for example.

Furthermore, a full color image forming technique is known, in which difference of the physical properties between the image forming toner and the transparent toner is noted and the difference between the particle diameter of the colored toner and that of the transparent toner is specified to obtaining the uniform glossiness; cf. Patent Document 4, for example.

Moreover, a technique is disclosed in which a transparent toner layer is formed on the image formed by a printer by using a glossing apparatus to provide a glossy printed matter. Such the apparatus is connected with a printer such as an electrophotographic printer and the transparent toner layer is entirely formed on the surface of the image formed by the printer, and the transparent toner layer is melted by heating the layer in a state of contacting with a belt. And then the transparent toner layer is solidified by cooling while contacting with the belt. The printed matter is naturally released from the belt after solidifying of the transparent toner layer; thus the printed matter having uniform glossy surface is finished; cf. Patent Documents 2 and 3, for example.

While the uniform glossy surface formed on the image is effective to give additive value, it sometimes damages the image of beauty by sticking finger prints on the image surface when naked hand touches the finished prints. For example, finger prints on the black area are remarkable when a monochrome image poster having higher density is prepared, and the stick finger prints affect commercial value. Therefore it is required to handle the printed matter not to give finger prints in the working place of print material, and countermeasure to avoid sticking fingerprints by the operators is applied to the utmost. Practically, the operators have thin gloves fitting closely to their hands to handle the print matters. However, there are problems that when operation is conducted always having gloves, hands become sultry by sweat and the print matters are stained by the stained gloves, and further the operator, who cannot stand the heat, touches carelessly without having gloves and stick finger prints.

Investigation has been conducted to avoid sticking finger prints on the product in various area in addition to the print matters in view of above described background. The counter measure techniques to avoid sticking finger prints include, for example, one applying coating composition of anti-finger print composition containing acrylic resin stipulating hydroxy value or UV ray curable type over print varnish composition containing specific compound; cf. Patent Documents 5 and 6, for example.

PRIOR ART DOCUMENT

Patent Document

Patent Document 1: JP-A H11-007174
Patent Document 2: JP-A 2007-140037
Patent Document 3: JP-A 2002-341619
Patent Document 4: JP-A 2004-258537
Patent Document 5: JP-A 2007-314608
Patent Document 6: JP-A 2009-073942

SUMMARY OF THE INVENTION

Problems to be Dissolved by the Invention

However, there is a fear to affect the productivity because increase of number of processes when the method in which a composition of anti-finger print composition is coated on a glossy surface is adopted funned by employing the transparent toner. Further the glossy surface obtained by direct coating UV ray curable type over print varnish composition on the image surface in place of a transparent toner is not expected to have the high level glossiness as one obtained by the transparent toner.

Further the anti-fingerprint coating composition and the UV ray curable type over print varnish composition are elaborate to maintain the performance of the coating composition. For example, the anti-fingerprint coating composition sometimes has difficulty to maintain the uniform coating composition due to sedimentation of dispersion component such as an acrylic resin, and therefore it is necessary to stir the composition sufficiently when it is used after long time storage. The UV ray curable type over print varnish composition contains a reactive monomer is elaborate in composition control during storage to maintain the reactivity such that it is necessary to keep in dark and cool place. Consequently it is not always preferable countermeasure to develop the techniques disclosed in the Patent documents 5 and 6 described above, for the countermeasure to the fingerprint sticking on the glossy surface in view of productivity, image quality as well as composition control.

The inventors consider, in these circumstances described above, that it is strictly difficult to dissolve the countermeasure to the finger print sticking on the glossy surface formed by employing the transparent toner by the techniques described above and that it is necessary to investigate a new technology for the countermeasure to finger print sticking on the cleat toner surface.

The invention is accomplished in view of the problems described above, and the object is to provide a glossy surface forming technique to obtain finishing without damage of the image of beauty even though finger prints are slick on the glossy surface formed by the transparent toner. Concretely the object is to provide a transparent toner by which uniform glossy surface without irregularity can be formed after supplied on the image support material, and a printed matter which does not damage the beautiful image can be formed even though finger prints stick on the glossy surface.

The inventors thought out to give a function of countermeasure to the finger print sticking to the transparent toner as itself, and studied a transparent toner having the above described function. After a result of study, a transparent toner having a function of countermeasure to the finger print sticking was realized by the following invention described below.

An embodiment of the invention is that, a transparent toner which is supplied to the image support material for forming a glossy surface, wherein a critical surface tension of a glossy surface formed by the transparent toner at 20° C. is at least 50 mN/m, and the transparent toner comprises a resin composed of a polymer formed by employing at least a polymerizable monomer containing a carboxylic group (—COOH).

It is preferable that a content ratio of the polymerizable monomer containing a carboxylic group (—COOH) in the polymer is 15% by mass or more.

It is preferable that the transparent toner is heated and melted after supplied to the image support material, is brought into contact with a belt while it is melted on the image support material, is cooled in a state of contacting with a belt, and forms a glossing layer on the image support material.

The other embodiment of the invention is that an image forming method comprising at least steps of heating and melting a transparent toner supplied on an image support material, bringing the image support material at a side in which the a transparent toner is supplied into contact with a belt, and cooling the transparent toner while contacting with the belt, releasing the image support material from the belt, wherein the transparent toner used in the image forming method has critical surface tension at 20° C. is at least 50 mN/m, and comprises a resin composed of a polymer formed by employing at least a polymerizable monomer containing a carboxylic group (—COOH).

It is preferable that a content ratio of the polymerizable monomer containing a carboxylic group (—COOH) in the polymer is 15% by mass or more in the image forming method described above.

ADVANTAGE OF THE INVENTION

A printed matter with beautiful finished image without damaging a beauty of glossy surface can be obtained even when finger print is stick by touching the glossy surface formed on an image support material with naked hand. And glossiness is obtained wherein glossy surface of finished image formed on a printed matter surface has glossiness sufficient level such that a clear image is reflected on a glossy surface at any area even there is a portion touched directly with hands.

Further, operators can handle printed matters without taking gloves, there is no problem of sultry hands y sweat, and improvement of productivity is made possible. Further countermeasure to the finger print sticking is realized without employing anti-finger print composition or reactive over print varnish composition, and prints can be prepared, without affecting productivity such as addition of coating process or reduction of image quality due to coating to the glossy surface.

EMBODIMENTS PRACTICING THE INVENTION

Figure 1:
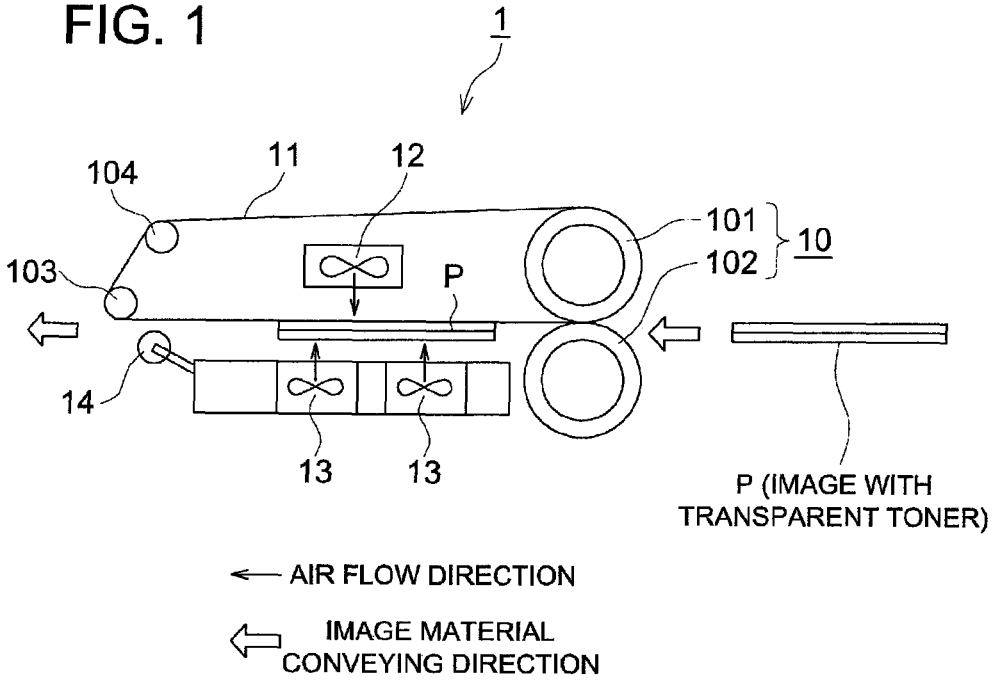
FIG. 1: A schematic view of a glossy layer forming apparatus forming a glossy layer on a whole surface of image support material by heating and melting transparent toner supplied on the whole surface of image support material.

The present invention relates to a colorless toner so called as transparent toner for providing gloss onto an image formed by a known printing method such as an electrophotographic method or an ink-jet method.

The inventors have found that the glossy surface formed by employing a transparent toner having critical surface tension of a glossy surface formed by the transparent toner at 20° C. is at least 50 mN/m, and the transparent toner comprises a resin composed of a polymer formed by employing at least a polymerizable monomer containing a carboxylic group (—COOH) does not damage beauty image and finger prints are not marked, even though finger prints are stick.

The inventors noticed that the sebaceous matter which is an organic material composing the fingerprint is easy to stick to glossy surface formed by a transparent toner composed of organic materials, and thought out a method by which beauty image in a stick area was not damaged even though finger prints stick on a glossy surface. They presumed that beauty image was damaged by generation of irregular reflection of light by the finger print at a portion stick finger print and reflection light generated in a different direction from that of the portion having no finger prints.

The investigation was conducted on a transparent toner which would not induce irregular reflection by finger print sticking and was capable of forming glossy surface reflecting light in the same direction to that from the portion having finger print. Concretely they noticed wetting property of sebaceous matter composing fingerprint, and considered that when glossy surface was made to be wet easily by sebaceous matter, sebaceous matter stuck along with glossy surface flatly and generation of irregular reflection was avoided and reflected light in the same direction as that of portion having no finger prints. And it has been found that a transparent toner having critical surface tension of at least 50 mN/m easily spread sebaceous matter composing fingerprints, in other words, it formed glossy surface having a property of easily wet by sebaceous matter.

The invention is described in detail.

The transparent toner referred to in the invention means toner particles containing no colorant displaying color by an action of light absorption or light scattering such as color pigment, color dye black carbon particles, black magnetic powder. The transparent according to the invention is normally colorless and transparent, and substantially colorless and transparent, even sometimes transparency decreases a little by species and amount of a resin, wax and an external additive. The transparent toner has transmittance of 80% or more and more preferably 90 or more through whole range of visible wavelength.

In the invention, the "image" is one having the state of medium capable of informing information such as images of characters or pictures to users. Namely, the "image" includes not only the area of the image support on which toner or ink exists but the area so called as white background on which no toner nor ink exists, and in the state capable of informing information to the users. The "image" of the invention includes both of one having the clear toner layer and one having no clear toner layer.

In the invention, the method for forming the image before the formation of the clear toner layer is not specifically limited, and ones prepared by usual image forming method such as electrophotographic system, printing work, ink-jet system of silver halide photographic system can be applied. The term of "finger print" directs in general those called sebaceous matter originated from human body such as fingerprints and thumb marks generated by touch with hands.

The transparent toner of the invention is described. The transparent toner of the invention has critical surface tension at 20° C. is at least 50 mN/m, and comprises a resin composed of a polymer formed by employing at least a polymerizable monomer containing a carboxylic group (—COOH).

The transparent toner of the invention has critical surface tension at 20° C. of at least 50 mN/m, and more preferably at least 53 mN/m. The critical surface tension is preferably not more than 70 mN/m at 20° C. The critical surface tension of the toner is substantially same as that of the glossy surface formed by the transparent toner on an image support.

The critical surface tension, which is a one kind of evaluating the surface state of solid material, is surface tension of liquid in the state in which liquid dripped on the surface of solid body does not form liquid droplets, but wets the surface of solid body (contact angle between the surface of solid body and the liquid being 0°). Practically, liquid with known surface tension is dripped on the surface of solid body, contact angle (θ) between the surface of solid body and the liquid just after the dripping is measured. Then surface tension of various liquid and cos θ are plotted on abscissa axis (x axis) and ordinate axis (y axis), respectively, (Zisman Plot), to obtain a chart showing linear relation. Surface tension is obtained by extrapolating θ being 0 in the chart. The surface tension value obtained by the extrapolation in which contact angle (θ) becomes 0 is the critical surface tension of the solid body. The term of critical surface tension of a transparent toner is the critical surface tension in a state that glossy surface is formed on the image support material using the transparent toner, that is, the critical surface tension of the glossy surface formed by the transparent toner.

Measurement of the critical surface tension of the transparent toner according to the invention can be conducted, for example, by the following procedures. A glossy surface for the measurement is formed on the image support material by employing the transparent toner at first. It is preferable that the glossy surface is formed, for example, in the same manner as the actual procedure of forming the glossy surface, and is preferable to use the glossy surface formed on the image support material by employing the glossing layer forming apparatus illustrated in FIG. 1 in the glossy surface condition of the invention for the measuring sample.

Next, liquid having known surface tension at 20° C. is dripped in a condition of temperature at 20° C. on a glossy surface prepared above, and the contact angle of the droplet as formed is measured by a contact angle meter obtained from the market. Concretely, 0.3 mg of droplets of pure water (surface tension at 20° C.: 72.8 mN/m), oleic acid (surface tension at 20° C.: 32.5 mN/m), heptanoic acid (surface tension at 20° C.: 28.3 mN/m) and the like respectively is chipped on a glossy surface, and 5 seconds after the dripping, contact angle is measured. The measured values thus obtained are plotted (Zisman Plot) to form a chart. The critical surface tension is obtained by extrapolating contact angle being 0 in the chart. The contact angle meter for measuring the contact angle of the droplets in the market includes a contact angle meter CA-DT, manufactured by Kyowa Interface Science Co., Ltd., and the like.

The glossy surface formed by employing the transparent toner of the invention has critical surface tension of at least 50 mN/m at 20° C. This is realized by a resin composed of a polymer formed by employing at least a polymerizable monomer containing a carboxylic group (—COOH). It is presumed that adequate polarity is given to the glossy surface by means of existence of carboxylic group of the polymer composed of the transparent toner, whereby wettability of the liquid having polarity such as water and fatty acid is accelerated. Further, sebaceous matter having certain degree of polarity sticks to the glossy surface with further smaller contact angle than the past by means of existence of a polar group such as water and peptide bond, whereby irregular reflection of light, which is presumed to generate by the existence of sebaceous matter, is inhibited. Consequently stains such as finger prints is not remarkable since light is scarcely reflects irregularly at the portion on which sebaceous matter is stuck, and light reflects in the same direction as the portion on which sebaceous matter is not stuck.

Surface property of glossy surface is improved by employing a polymerizable monomer containing a carboxylic group (—COOH) at a time of forming the resin composing the transparent toner, and it becomes possible to avoid from generation of stain on the glossy surface by sebaceous matter such as fingerprints, as described above in the invention. In the invention, result that stain such as fingerprints is not remarkable is obtained by employing 15% by mass or more of the polymerizable monomer containing a carboxylic group (—COOH) in the polymer, as demonstrated in the Examples described later. It is preferable that the amount of the polymerizable monomer containing a carboxylic group (—COOH) in the polymer is not less than 15% by mass and not more than 50% by mass, and more preferably not less than 15% by mass and not more than 25% by mass in the polymer. The stains of finger print and the like are not remarkable and in addition thereto low temperature fixing performance and storage stability against heat are improved in the above described range.

Practical examples of the polymerizable monomer containing a carboxylic group (—COOH) for forming the transparent toner according to the invention include a vinyl type monomer containing a carboxylic group. Practical examples of the a vinyl type monomer containing a carboxylic group (—COOH) include, at first, a compound containing one carboxylic grouping a molecule structure, such as acrylic acid and methacrylic acid. Examples of a vinyl type monomer containing two carboxylic groups include itaconic acid, maleic acid and fumaric acid, and examples of a vinyl type monomer containing three carboxylic groups include aconitic acid. Practical examples a vinyl type monomer containing a carboxylic group (—COOH) are listed below. The vinyl type monomer containing a carboxylic group usable in the invention is not limited to those mentioned above or listed below.

(1)

$H_2C{=}C(CH_3)COOH$

Methacrylic acid (2)

$H_2C{=}CHCOOH$

Acrylic acid (3)

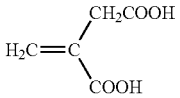

Itaconic acid (4)

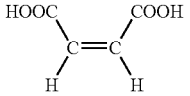

Maleic acid (5)

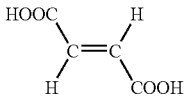

Fumaric acid (6)

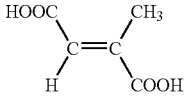

Mesaconic acid (7)

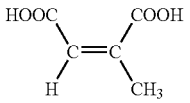

Citraconic acid (8)

$HOOC{-}CH{=}CHCH_2COOH$

2-Pentene diacid (9)

$H_2C{=}CHCH_2CH(COOH)_2$

Allyl malonic acid (10)

$(H_3C)_2C{=}C(COOH){-}CH_2COOH$

Isopropylidene succinic acid

-continued (11)

$HOOC{-}CH{=}CHCH{=}CH{-}COOH$ 2,4-Hexadiene diacid (12)

$HOOC{-}C{\equiv}C{-}COOH$

Acetylene dicarboxylic acid (13)

$HOOC{-}CH{=}C(COOH){-}CH_2COOH$

Aconitic acid

Description is made on a vinyl type monomer used for forming the transparent toner of the invention in combination with a vinyl type monomer containing a plurality of polar groups described above. The vinyl type monomer used for forming the transparent toner of the invention in combination with a vinyl type monomer containing a plurality of polar groups is not particularly limited, and known vinyl type monomer can be used.

Practical examples of usable vinyl type monomers are listed. The vinyl type monomer usable for forming the transparent toner of the invention is not limited to those listed below.

(1) Styrene and its Derivatives

Styrene, o-methylstyrene, m-methylstyrene, p-methylstyrene, α-methylstyrene, p-chlorostyrene, 3.4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene and p-n-dodecylstyrene;

(2) Methacrylate Derivatives

Methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) Acrylate Derivatives

Methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate;

(4) Olefins

Ethylene, propylene and isobutylene;

(5) Vinyl Esters

Vinyl propionate, vinyl acetate and vinyl benzoate;

(6) Vinyl Ethers

Vinyl methyl ether and vinyl ethyl ether;

(7) Vinyl Ketones

Vinyl methyl ketone, vinyl ethyl ketone and vinyl hexyl ketone;

(8) N-Vinyl Compounds

N-vinylcarbazole, N-vinylindole and N-vinylpyrrolidone; and (9) Others

Vinyl compounds such as vinylnaphthalene and vinylpyridine, acrylic or methacrylic derivatives such as acrylonitrile, methacrylonitrile, and acrylamide.

Further, it is possible to prepare resins having a cross-linking structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate.

Molecular weight of the resin listed above is not particularly limited as far as the performance as the transparent toner can display stably, and it is preferable that number average molecular weight Mn of 5,000 to 50,000. One of the preferable examples is that having Mw/Mn, a ratio of weight average molecular weight Mw to number average molecular weight Mn of 1.0 to 1.5. A sharp melting performance is displayed at the fixing process when the number average molecular weight Mn and weight average molecular weight Mw of the resin composing the transparent toner of the invention satisfy the relationship described above, and this is expected to contribute to forming glossy surface having high image picturing.

A preparation method of the transparent toner of the invention is described.

The transparent toner according to the invention has a critical surface tension of a glossy surface formed by the transparent toner at 20° C. of at least 50 mN/m, and comprises a resin composed of a polymer formed by employing at least a polymerizable monomer containing a carboxylic group (—COOH). A manufacturing method of particles composing the transparent toner of the invention is not particularly limited, and known manufacturing method of toners used in the electrophotographic image forming can be applied. That is, such a method can be applied as so called a pulverization method in which toner is manufactured via processes of kneading, pulverization and classification, and so called a polymerization method in which particles are formed by polymerization of a polymerizable monomer and simultaneously controlling the shape or particle size.

The transparent toner manufactured by the polymerization method is said to easily obtain properties such as uniform particle size distribution, shape distribution and sharp charge distribution among them. The manufacturing method by polymerization method has a process to form resin particles by polymerization reaction such as suspension polymerization and emulsion polymerization. It is particularly preferable to manufacture via association process in which resin particles manufactured by polymerization are subjected to coagulation and fusion to form particles.

A manufacturing method of the transparent toner by emulsion association method is described as an example. The A manufacturing method of the transparent toner by emulsion association method is conducted, for example, by the following processes.

(1) Process of preparation of dispersion liquid of resin microparticles (2) Process of coagulation and fusion of the resin microparticles (3) Process of ripening (4) Process of cooling (5) Process of washing (6) Process of drying (7) Process of adding an external additive Each process is described.

(1) Process of Preparation of Dispersion Liquid of Resin Microparticles

This is a process to form a resin composing the transparent toner. Concretely, a polymerizable monomer mixture composition such as the above mentioned polymerizable monomer containing a carboxylic group (—COOH) is dispersed in an aqueous medium, and polymerization is conducted under this state to form microparticles in an embodiment.

Resin microparticles are formed by adding the above mentioned polymerizable monomer having carboxylic group in an aqueous medium and so on, and after that dispersing it to form oil droplets of the polymerizable monomer mixture composition. Then the resin microparticles are formed by conducting radical polymerization reaction inside of the oil droplets dispersed in the aqueous medium in this process.

The radical polymerization reaction is a process wherein a polymerization initiator is incorporated inside of the above mentioned oil droplets to generate radicals, polymerization reaction of the polymerizable monomer forming the oil droplets is initiated, and resin is formed by the polymerization reaction. Polymerization reaction can be initiated by supplying radicals generated from the polymerization initiator added in the aqueous medium into oil droplets by known method in other way.

Temperature during the radical polymerization depends on the species of a polymerizable monomer including the polymerizable monomer having a carboxylic group and an initiator generating radicals, and usually is preferably 50 to 100° C., and more preferably 55 to 90° C. The reaction time, which depends on reaction rate of polymerizable monomer used in the polymerization reaction or generated radicals, is preferably 2 to 12 hours.

Oil droplets of the monomers are formed by that the styrene monomer, acrylic acid ester monomer, polycarboxylic acid and polyalcohol are added and dispersed in an aqueous medium and these are subjected to dispersion process via an activity of mechanical energy. Dispersion apparatus in which oil droplets dispersion is carried out via application of mechanical energy are not particularly limited, but examples thereof include "CLEARMIX", ultrasonic homogenizers, mechanical homogenizers, Manton-Gaulin, and pressure system homogenizers. Further, the dispersed particle diameter of the polymerizable monomer solution is preferably about 100 nm.

The aqueous medium refers to a medium containing water in an amount of at least 50% by mass. As components other than water are cited water-soluble organic solvents and examples thereof include methanol, ethanol, isopropanol, butanol, acetone, methyl ethyl ketone and tetrahydrofuran. Of these solvents, it is preferred to use organic solvents which do not dissolve a resin, for example, alcoholic solvents such as methanol, ethanol, isopropanol and butanol.

(2) Process of Coagulation and Fusion of the Resin Microparticles

This is a process to form particles by coagulating resin microparticles formed by the above described process and to form mother particles for transparent toner having no external additives by fusing the coagulated particles. Particles are manufactured by coagulating and fusing the resin microparticles formed by polymerizing polymerizable monomer having a carboxylic acid group and other polymerizable monomer.

In this step, a coagulant of an alkali metal salt or an alkaline earth metal salt such as magnesium chloride is added to an aqueous medium containing resin particles to coagulate these particles. Subsequently, the aqueous medium is heated at a temperature higher than the glass transition temperature of the resin particles to allow coagulation to proceed and to allow coagulated resin particles to fuse. When allowing coagulation to proceed and reach the targeted particle size, a salt such as sodium chloride is added to stop coagulation.

(3) Ripening:

Ripening is a step of shape controlling step following the coagulation and fusing step, and a system including coagulated particles is stirred with heating, until the shape of toner particles reaches the intended average circularity.

(4) Cooling:

This step refers to a stage that subjects a dispersion of the foregoing toner particles to a cooling treatment (rapid cooling). Cooling is performed at a cooling rate of 1 to 20° C./min. The cooling treatment is not specifically limited and examples thereof include a method in which a refrigerant is introduced from the exterior of the reaction vessel to perform cooling and a method in which chilled water is directly supplied to the reaction system to perform cooling.

(5) Washing:

In the washing step, a solid-liquid separation treatment of separating toner particles from a toner particle dispersion is conducted, then cooled to the prescribed temperature in the foregoing step and a washing treatment for removing adhered material such as a surfactant or salting-out agent from a separated toner particles (aggregate in a cake form) is applied.

In this step, washing is conducted until the filtrate reaches a conductivity of 10 μS/cm. A filtration treatment is conducted, for example, by a centrifugal separation, filtration under reduced pressure using a Buchner's funnel or filtration using a filter press, but the treatment is not specifically limited.

(6) Drying:

In this step, the washed toner cake is subjected to a drying treatment to obtain dried colored particles. Drying machines usable in this step include, for example, a spray dryer, a vacuum freeze-drying machine, or a vacuum dryer. A standing plate type dryer, a movable plate type dryer, a fluidized-bed dryer, a rotary dryer or a stirring dryer is preferably used.

The moisture content of the dried toner particles is preferably not more than 5% by mass, and more preferably not more than 2% by mass. When toner particles that were subjected to a drying treatment are aggregated via a weak attractive force between particles, the aggregate may be subjected to a pulverization treatment. Pulverization can be conducted using a mechanical pulverizing device such as a jet mill, Henschel mixer, coffee mill or food processor.

(7) External Additive Addition:

In this external additive treatment step, external additives or a lubricant is added to dried transparent toner mother particles. Transparent toner mother particles which were subjected to the drying step may be used as toner particles, but addition of external additives can enhance the electrostatic-charging property, fluidity and cleaning property. External additives usable in the present invention include, for example, organic or inorganic particles and aliphatic metal salts. An external additive is added preferably in an amount of 0.1 to 10.0% by mass, and more preferably 0.5 to 4.0% by mass. A variety of additives may be combined. Examples of a mixing device, used to add external additives include a tabular mixer, a HENSCHEL MIXER, a NAUTA Mixer, a V-type mixer and a coffee mill.

Inorganic microparticles may be employed. Specifically, it is possible to preferably employ minute silica, titanium, and alumina particles and the like. These minute inorganic particles subjected to hydrophobic processing may be used.

Specifically listed as silica microparticles, for example, are commercially available R-805, R-976, R-974, R-972, R-812, and R-809, produced by Nippon Aerosil Co. Ltd.; HVK-2150 and H-200, produced by Hoechst AG; commercially available TS-720, TS-530, TS-610, H-5, and MS-5, produced by Cabot Corp; and the like.

Listed as titanium microparticles, for example, are commercially available T-805 and T-604, produced by Nippon Aerosil Co., commercially available MT-100S, MT-100B, MT-500BS, MT-600, MT-600SS and KA-1, produced by TAYCA CORPORATION; commercially available TA-300SI, TA-500, TAF-130, TAF-510 and TAF-510T, produced by Fuji Titanium Industry Co., Ltd.; commercially available IT-S, IT-OA, IT-OB and IT-OC, produced by Idemitsu Kosan Co.; and the like.

Listed as alumina microparticles, for example, are commercially available RFY-C and C-604, produced by Nippon Aerosil Co., commercially available TTO-55, produced by ISHIHARA SANGYO KAISHA, LTD, and the like.

Further, employed as fine organic particles are fine spherical organic particles having a number average primary particle diameter of 10 to 2,000 nm. Employed as such particles may be homopolymers or copolymers of styrene or methyl methacrylate.

The transparent toner according to the invention can be manufactured via emulsion association process through the steps described above.

Polymerization initiator, dispersion stabilizer; surfactant and the like which can be used in the emulsion association method manufacturing the transparent toner according to the invention are described.

A binding resin composing the transparent toner according to the invention is formed by employing a polymerizable monomer having a carboxyl group on a side chain as described above, and oil soluble or water soluble polymerization initiator can be used Practical example of the oil soluble initiator includes azo type and diazo type polymerization initiators and a peroxide initiator described below.

(1) Azo Based or Diazo Based Polymerization Initiators;

2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, (2) Peroxide Based Polymerization Initiators;

benzoyl peroxide, methyl ethyl ketone peroxide, diisopropylperoxy carbonate, cumenehydroperoxide, t-butylhydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy) triazine.

Water soluble radical polymerization initiator can be used when the resin particles are formed by an emulsion polymerization method. The water soluble radical polymerization initiator includes a persulfate salt such as potassium persulfate or ammonium persulfate; azobisaminodipropane acetic acid salts; azobiscyanovaleric acid and salts thereof, and hydrogen peroxide.

In this polymerization step, conventionally used chain transfer agents can be employed in order to regulate the molecular weight of the targeted core forming binder rosin. A chain transfer agent used for the present invention is not specifically limited. Examples of a chain transfer agent include: a mercaptan such as n-octylmercaptan, n-decylmercaptan, or tert-dodecylmercaptan; a mercaptopropionic acid ester such as n-octyl-3-mercaptopropionic acid ester; terpinolene; and α-methylstyrene dimer.

The transparent toner is manufactured by polymerizing vinyl type monomers including polymerizable monomer containing carboxyl group described above in a state of aqueous dispersion, then dispersing the prepared resin microparticles, which are coagulated and fused to manufacture the transparent toner. It is preferable to use dispersion stabilizers so as to disperse these toner raw material stably in aqueous medium. Examples of dispersion stabilizers include tricalcium phosphate, magnesium phosphate, zinc phosphate, aluminum phosphate, calcium carbonate, magnesium carbonate, calcium hydrate, magnesium hydrate, aluminum hydrate, calcium metasilicate, calcium sulfate, barium sulfate, bentonite, silica and alumina. Further, polyvinyl alcohol, gelatin, methylcellulose, sodium dodecylbenzene sulfonate, an ethyleneoxide adduct and high alcohol sodium sulfate, which are commonly usable as surfactants, can also be utilized as dispersion stabilizers.

It is necessary to disperse the oil droplets of the polymerizable monomer described above in an aqueous medium stably using a surfactant when the polymerization is conducted employing the polymerizable monomers in the aqueous medium. Surface active agents include sulfonic acid salts such as sodium dodecylbenzenesulfonate, sodium arylalkylpolyethersulfonate, sodium 3,3-disulfondiphenylurea-4,4-diazo-bis-amino-8-naphthol-6-sulfonate, ortho-carboxybenzene-azo-dimethylaniline, sodium 2,2,5,5-tetramethyltriphenylmethane-4,4-diazo-bis-β-naphthol-6-sulfonate, etc.

Sulfonic ester salts includes sodium tetradecylsulfate, sodium pentadecylsulfate, sodium octylsulfate, etc., fatty acid salts such as sodium oleate, sodium laurate, sodium caprate, sodium caprylate, sodium caproate, potassium stearate, calcium oleate, etc.

Further, nonionic surfactant also may be employed. Examples are mentioned as polyethyleneoxide, polypropyleneoxide, combination of polypropyleneoxide and polyethyleneoxide, ester of polyethyleneglycol and higher fatty acid, alkylphenol polyethyleneoxide, ester of higher fatty acid and polyethylene glycol, ester of higher fatty acid and polypropyleneoxide, sorbitan ester.

The image forming method employing the transparent toner according to the invention is described.

The image fanning method employing the transparent toner according to the invention comprises the following steps.

(1) A step of heating and melting the transparent toner supplied on the image support material.

(2) A step of bringing the image support material at a side on which the transparent is supplied into contact with a belt, and cooling the transparent toner while contacting with the belt.

(3) A step of releasing the image support material from the belt.

A uniform glossy layer is formed on the image support material by employing the transparent toner according to the invention as described above in this invention. A method to form an image other than the glossy layer on the image support material is not particularly limited. Practically, it includes images formed by known image forming method such as an electrographic method, a presswork method, an ink-jet method, and a silver salt photographic method. The transparent toner according to the invention is supplied on the image support material having an image described above, is melted by heating, and the melted transparent toner layer is cooled while it is in contact with a belt to form a smooth glossy surface.

Practical example of the image forming apparatus which is capable of an image forming method employing the transparent toner according to the invention is described. FIG. 1 is a schematic diagram showing a typical example of a gloss providing device which forms a highly glossy surface on the image support material by heating and melting the transparent toner supplied on the image support material.

The glossing layer forming apparatus illustrated in FIG. 1 can be used in connection with the image forming apparatus such as a printer and a presswork apparatus. The transparent toner supplied on the image support material at a side having an image formed by an image forming apparatus such as a printer is heated and melted by a fixing roller at first. Next the image support material is brought into contact with a belt member via the melted transparent toner, and in this state the transparent toner is cooled and solidified while the image support material is conveyed. After the transparent toner layer formed on the whole surface of mage support material is solidified, the image support material is released from the belt member. A printed matter having uniform glossy surface is finished on the image support material in such a manner.

The gloss-providing device 1 shown in FIG. 1 has at least the following constitutions.

(1) Heating and pressing device 10 in which image support material P on which the transparent toner is provided on the image is heated while being pressed;

(2) Belt member 11 which contacts the transparent toner layer which is melted by the heating and pressing device 10 to form a contact surface between the transparent toner surface, and conveys the image support material P;

(3) Cooling fans 12 and 13 which supply cooling air to the image support material P which is being conveyed while being in contact with belt member 11;

(4) Conveyance roll 14 which conveys the image support material P on which the transparent toner layer is fixed by cooling with the air supplied from cooling fans 12 and 13.

Hereafter, each constitution will be specifically explained.

Heating/pressurizing member 10 will be described, first.

In heating/pressurizing member 10 shown in FIG. 1, image support material P having an image and transparent toner on its surface is inserted between a pair of rolls 101 and 102 driven at a constant speed to be carried and image support material P is heated and pressurized. Namely, the transparent toner on the image support material P is melted by the heat supplied from heating/pressurizing member 10 and the melted transparent toner forms a transparent toner layer having a smooth and glossy surface by being pressurized. By providing a heat source in the center of one of the pair of rolls 101 and 102, Or both, the heat source can heat so that the transparent toner on the image support material is melted. The pair of rolls 101 and 102 preferably have a structure in that the two roll are pushed each other so as the surely pressurize the melted transparent toner between the rolls.

The gloss-providing device 1 shown in FIG. 1 may have a structure in which roll 101 works as a heating roll and roll 102 works as a pressurizing roll, with respect to the electrical consumption and working efficiency, by which sufficient heating and pressurizing are possible. On the surface of one of or both of roll 101 and roll 102 constituting the heating/pressurizing member 10, a silicone rubber or a fluorine containing rubber may be provided, and the width of the nip region where heating and pressurizing are conducted is preferably 1 to 8 mm.

Heating roll 101 has a structure in which an elastic layer containing, for example, a silicone rubber is coated on a surface of a metallic core made of, for example, aluminum to have a predetermined outer diameter. In the inside of heating roll 101, for example, a 300 to 350 W halogen lamp is installed as a heat source to heat the heating roll 101 from inside so that the surface temperature reaches the predetermined temperature.

Pressurizing roll 102 has a structure in which an elastic layer containing, for example, a silicone rubber is coated and covered by, for example, a tube of PFA (tetrafluoroethylene/perfluoroalkyl vinylether copolymer) as a separator layer, on a surface of a metallic core made of, for example, aluminum to have a predetermined outer diameter. Also in the inside of pressure roll 102, for example, a 300 to 350 W halogen lamp may be installed as a heat source to heat the pressure roll 102 from inside so that the surface temperature reaches the predetermined temperature.

In the heating/pressurizing member 10, image support material P having an image and transparent toner on its surface is introduced between the rolls which are pushed with each other (nip portion) so that the surface provided with the transparent toner is on the heating roll 101 side, and while it passes through the portion where rolls 101 and 102 are pushed with each other, the transparent toner is melted by the heat and simultaneously fused onto the image to form a transparent toner layer.

Next, the belt member 11 will be explained. As shown in FIG. 1, belt member 11 has an endless belt structure which is supported by heating roll 101 and other plural belts including healing belt 101, namely, rolls 101, 103 and 104, so as to be rotatable. As mentioned above, the belt member 11 is set up to rotate by plural rolls including heating roll 101, separation roll 103, and driven roll 104, and driven to rotate at a predetermined speed by heating roll 101 which is rotated by a drive source which is not illustrated. Thus, belt member is driven to rotate at a predetermined process speed without wrinkle by the drive forth due to heating roll 101 and a tension provided by separation roll 103 and driven roll 104.

Since the belt member 11 forms a contact surface with the melted transparent toner surface and the image support material P is conveyed through the melted transparent toner surface, it can be produced with a material which possesses a certain extent of heat resistance and mechanical strength. Specifically, for example, heat-resistant film resins such as polyimide, polyether polyimide, PES (polyethersulfone) and PFA (tetrafluoro ethylene/perfluoroalkyl vinylether copolymer) are cited. It is preferable that, a release layer containing a fluorine containing resin such as PTFE (polytetrafluoroethylene) or PFA, or a silicone rubber is formed on at least a surface where the transparent toner layer contacts of the abovementioned heat-resistant film resin.

The thickness of belt member 11 is not specifically limited if the image support material can be conveyed through a contact surface with the melted transparent toner surface, and a belt member with a suitable thickness is usable. Specifically, the thickness of a heat-resistant film resin is preferably 20 to 80 μm, the thickness of a release layer is preferably 10 to 30 μm, and the total thickness is preferably 20 to 110 μm. Specific example is an endless film made of polyimide having thickness of 80 μm, coated with silicone rubber layer of 30 μm, thickness.

Next, cooling fans 12 and 13 will be described. The gloss-providing device 1 shown in FIG. 1 has cooling fan 12 between heating roll 101 and separation roll 103 in the inside of foregoing belt member 11, and has cooling fan 13 between pressurizing roll 102 on the outside of belt member 11 and conveyance assist roll 14. Here, the outer surface of belt member 11 is a suffice which contacts to the image support material, and the image support material P is conveyed while it is contacted to the outer surface of belt member through the melted transparent toner.

In gloss-providing device 1 of FIG. 1, the transparent toner layer is melted by aforementioned heating/pressurizing member 10 and pressed to attain a predetermined thickness. The image support material P is conveyed while the transparent toner layer is adhered on the outer surface of belt member 11, and simultaneously, the transparent toner layer is cooled to solidify. Cooling fans 12 and 13 compulsorily cools the image support material P having the transparent toner layer while being conveyed. Gloss-providing device 1 may be equipped with a heat sink or a heat pipe for cooling in connection with cooling fans 12 and 13. By means of such a heat sink or heat pipe for cooling, the cooling and solidifying the melted transparent toner layer can be promoted.

The solidification of the transparent toner layer of the image support material P under conveyance by the belt member 11 is promoted by forced cooling by the abovementioned cooling fans 12 and 13, and the transparent toner layer is fully cooled and hardened when the transparent toner layer is conveyed near the end where conveyance assist roll 14 and separation rolls 103 are provided. Then, the image support material P is separated from the belt member 11, according to the following procedures.

The image support material P conveyed near the end is conveyed while supported by belt member 11 through the transparent toner layer. In this condition, conveyance assist roll 14 becomes in touch with the back surface of image support material P to assist the conveyance. When image support material P is conveyed to separation roll 103 while supported by conveyance assist roll 14 from backside, belt member 11 changes the conveyance direction toward driven roll 104 (upward in the figure). At this moment, image support material P is separated from belt member 11 according to the stiffness of image support material P itself and discharged from gloss providing device 1 by the conveyance assist roll 14.

According to the procedures mentioned below, gloss providing device 1 heats and pressurizes the image support material having an image and transparent toner to form a melted transparent toner layer. The process includes the followings.

(1) A step of heating and melting the transparent toner supplied on the image support material.

(2). A step of bringing the image support material into contact with a belt member via melted transparent toner and cooling and solidifying the transparent toner while conveying in this state.

(3) A step of peeling the image support material from the belt member at a stage wherein the transparent toner is sufficiently solidified.

(4) A step of taking out the image support material peeled off from the belt member to the outside of the gloss providing device.

Separation of image support material P from belt member 11 is conducted with the aid of conveyance assist roll 14 and separation roll 103. It is also possible to use, for example, a separation claw placed between belt member 11 and image support material P, instead of separation roll 103.

The image support material which can form a glossy image employing the transparent toner according to the present invention is not specifically limited, if image is formed and maintains the transparent toner layer. As the image support material usable in the present invention, materials, for example, a regular paper from a thin paper to a thick paper, a fine quality paper, and an art paper, a printing paper, such as a coated paper, a commercial Japanese paper, a plastic film for an over head projector and a cloth are cited.

The printed matter having a glossing layer formed on the image support material by employing the transparent toner according to the invention has uniform glossiness without damaged beauty appearance due to fingerprint even though there is a portion sticking fingerprint on a glossy surface, as described above. The term of glossiness is quantification of the degree of reflection at the surface of the image support material when light is irradiated on the surface of the image support material on which a transparent toner is formed under a predetermined condition, and is obtained by, for example, the following procedure. A value measuring surface of a transparent toner layer (glossy surface) which is formed by covering the whole surface of the image support material with the transparent toner by a glossimeter GMX-203, manufactured by Murakami Color Research Laboratory Co., Ltd., according to JIS Z8741 1997, method 5, with angle of incidence (referred also as measuring angle) of 20°.

Figure 2:
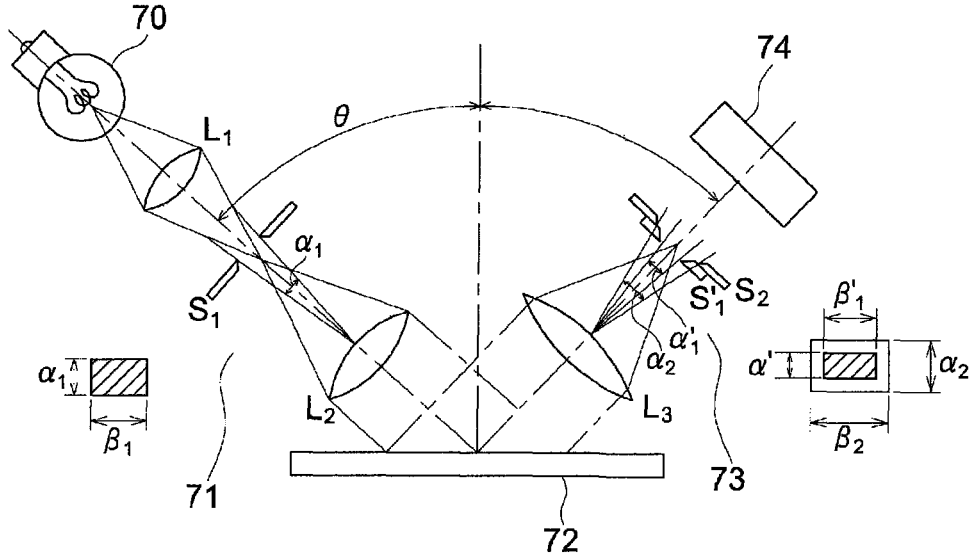
FIG. 2: A conception view of a glossiness measuring apparatus (gloss meter).

A schematic view of the glossimeter is illustrated in FIG. 2. Glossiness is measured by employing an apparatus illustrated in FIG. 2 schematically as follows. Light flux is radiated into a sample (image support material on which the transparent toner is formed) from light source 70 through an optical system composing lens $L_1$, opening $S_1$ of the light source and lens $L_1$ with designated incidental angle having designated opening angle, and reflected light from the sample 72 is received by photo detector 74 through the optical system 73, light flux having designated angle reflecting to reflecting direction. Opening $S_1$ of the light source is set at focus position of $L_2$, and image of $S_1$ forms clear image at a center of opening $S_2$ of the photo detector when minor surface is set at a position of the sample 72. Incident angle θ an angle formed between a line connecting the center of opening $S_1$ to the center of lens $L_2$ (principal point of lens) and normal of sample 72. The opening angle (within plane of incidence: $\alpha_1$, within vertical plane: $\beta_1$), opening angle of photo detector (within plane of incidence: $\alpha_2$, within vertical plane: $\beta_2$) are angle formed by opening $S_1$ and $S_2$ at the position of lens $L_1$ and L2, respectively, and the opening angle of the light source image (within plane of incidence: $\alpha'_1$, within vertical plane: $\beta_1$) are angle formed by image opening $S_1'$ of opening $S_1$ at the position of lens L1. Optical axes at incident side and light receiving side cross on the surface of the sample. Glossiness G is represented by the following formula, wherein ϕ is mirror reflection light flux from the surface of the sample and ϕs is reflection light flux from standard plane with respect to designated incident angle θ in the drawing.

$$\text{Glossiness } G=(\phi/\phi s)\times(\text{glossiness used standard plane})$$

The glossiness of the standard plane by above mentioned HS is based on mirror glossiness of glass surface having refractive index of constant value 1.567 through whole range of visible wavelength at incident angle θ, and this is designated as 100%. Glossiness of the glossy layer formed by the transparent toner according to the invention is, as confirmed by, for example, the result of EXAMPLE described later, is 60% or higher even at a portion on which finger prints stick.

EXAMPLE

The embodiments of the invention are concretely described by means of Example. The invention is not limited to these. The term of parts denotes parts by weight 1. Preparation of Transparent Toners 1 Through 12

Transparent Toners 1 through 12 were prepared by the procedure described as following.

1-1. Preparation of Resin Microparticles Dispersion Composition A1 through A10

Resin microparticles dispersion composition A1 through A10 were prepared by the procedure set forth below.

(1) Preparation of Resin Microparticles Dispersion Composition A1

(a) First Step Polymerization

The following compounds were poured into a vessel equipped with a stirrer.

| | |
|---|---|
| Styrene | 200 parts by weight |
| n-Butylacrylate | 87 parts by weight |
| methacrylic acid | 72 parts by weight |
| n-Octylmercaptan | 5.4 parts by weight |

It was heated up to 80° C., and was referred to Mixture Composition 1.

On the other side, 5 parts by weight of anionic surfactant (sodium polyoxyethylene-2-dodecyl ether sulfate) was dissolved in 800 parts by weight of ion exchanged water to prepare surfactant aqueous solution, it was heated up to 83° C. and Mixture Composition 1 described above was added. After that it was subjected to mixing and dispersing treatment over one hour by employing mechanical type dispersion device having a circulation pass CLEARMIX manufactured by M Technique Co., Ltd., and dispersion composition containing emulsified particles having dispersion particle diameter of 170 nm was prepared.

Solution of 12 parts by weight of potassium persulfate (KPS) dissolved in 230 parts by weight of ion exchanged water was added into the dispersion composition, the temperature of the system was made 82° C. and polymerization reaction was conducted by heating and stirring over one hour. Thus Resin Microparticles Dispersion Composition A1 was prepared.

(b) Second Step Polymerization

A solution of 10 parts by weight of potassium persulfate (KPS) dissolved in 200 parts by weight of ion exchanged water was added to the above described Resin Microparticles Dispersion Composition A1, the temperature of the system was made 82° C. and then Mixture Composition 2 composed of the following compounds was dripped over 1.5 hours.

| | |
|---|---|
| Styrene | 324 parts by weight |
| n-Butylacrylate | 141 parts by weight |
| Methacrylic acid | 116 parts by weight |
| n-Octylmercaptan | 7.5 parts by weight |

After completion of dripping, polymerization reaction was conducted by heating and stirring at 82° C. for 2 hours, and it was cooled down to 28° C. to obtain Resin Microparticles Dispersion Composition A1. Content of vinyl type monomers used for forming the resin microparticles A1 composing Resin Microparticles Dispersion Composition A1 was composed of 56% by weight of styrene, 24% by weight of n-butylacrylate and 20% by weight of methacrylic acid.

(2) Preparation of Resin Microparticles Dispersion Composition A2

Resin microparticles dispersion composition A2 was prepared in the same procedure as Resin Microparticles Dispersion Composition A1, except that the adding amounts of the polymerizable monomers used in the first step polymerization were modified to as follows.

| | |
|---|---|
| Styrene | 154 parts by weight |
| n-Butylacrylate | 128 parts by weight |
| Methacrylic acid | 94 parts by weight, |

And the adding amounts of the polymerizable monomers used in the second step polymerization were modified to as follows.

| | |
|---|---|
| Styrene | 231 parts by weight |
| n-Butylacrylate | 192 parts by weight |
| Methacrylic acid | 141 parts by weight |

Content of vinyl type monomers used for forming the resin microparticles A2 composing Resin Microparticles Dispersion Composition A2 was composed of 41% by weight of styrene, 34% by weight of n-butylacrylate and 25% by weight of methacrylic acid.

(3) Preparation of Resin Microparticles Dispersion Composition A3

Resin microparticles dispersion composition A3 was prepared in the same procedure as Resin Microparticles Dispersion Composition A1, except that cyclohexyl methacrylate ($CH_2{=}C(CH_3)COOC_6H_{11}$) was used in place of styrene, and the monomers used in the first step polymerization were modified below.

| | |
|---|---|
| Cyclohexyl methacrylate | 263 parts by weight |
| n-Butylacrylate | 56 parts by weight |
| Methacrylic acid | 56 parts by weight |

And the adding amounts of the polymerizable monomers used in the second step polymerization were modified to as follows.

| | |
|---|---|
| Cyclohexyl methacrylate | 395 parts by weight |
| n-Butylacrylate | 85 parts by weight |
| Methacrylic acid | 85 parts by weight |

Content of vinyl type monomers used for forming the resin microparticles A3 composing Resin Microparticles Dispersion Composition A3 was composed of 70% by weight of cyclohexyl methacrylate, 15% by weight of n-butylacrylate and 15% by weight of methacrylic acid.

(4) Preparation of Resin Microparticles Dispersion Composition A4

Resin microparticles dispersion composition A4 was prepared in the same procedure as Resin Microparticles Dispersion Composition A1, except that acrylic acid ($CH_2{=}CHCOOH$) was used in place of methacrylic acid, and the monomers used in the first step polymerization were modified below.

| | |
|---|---|
| Styrene | 248 parts by weight |
| n-Butylacrylate | 64 parts by weight |
| Acrylic acid | 64 parts by weight |

And the adding amounts of the polymerizable monomers used in the second step polymerization were modified to as follows.

| | |
|---|---|
| Styrene | 372 parts by weight |
| n-Butylacrylate | 96 parts by weight |
| Acrylic acid | 96 parts by weight |

Content of vinyl type monomers used for forming the resin microparticles A4 composing Resin Microparticles Dispersion Composition A4 was composed of 66% by weight of styrene, 17% by weight of n-butylacrylate and 17% by weight of acrylic acid.

(5) Preparation of Resin Microparticles Dispersion Composition A5

Resin microparticles dispersion composition A5 was prepared in the same procedure as Resin Microparticles Dispersion Composition A1, except that adding amount of methacrylic acid was modified as well as itaconic acid was used in combination.

First Step Polymerization:

| | |
|---|---|
| Methacrylic acid | 25 parts by weight |
| Itaconic acid | 47 parts by weight |

Second Step Polymerization:

| | |
|---|---|
| Methacrylic acid | 41 parts by weight |
| Itaconic acid | 75 parts by weight |

Content of vinyl type monomers used for forming the Resin Microparticles Dispersion Composition A5 was composed of 56% by weight of styrene, 24% by weight of n-butylacrylate, 7% by weight of acrylic acid and 13% by weight of itaconic acid.

(6) Preparation of Resin Microparticles Dispersion Composition A6

Resin microparticles dispersion composition A6 was prepared in the same procedure as Resin Microparticles Dispersion Composition A1, except that adding amount of methacrylic acid was modified as well as itaconic acid having two carboxylic groups and aconitic acid having three carboxylic groups in a molecule were used in combination.

First Step Polymerization:

| | |
|---|---|
| Methacrylic acid | 25 parts by weight |
| Itaconic acid | 24 parts by weight |
| Aconitic acid | 23 parts by weight |

Second Step Polymerization:

| | |
|---|---|
| Methacrylic acid | 41 parts by weight |
| Itaconic acid | 39 parts by weight |
| Aconitic acid | 36 parts by weight |

Content of vinyl type monomers used for forming the Resin Microparticles Dispersion Composition A6 was composed of 56% by weight of styrene, 24% by weight of n-butylacrylate, 7% by weight of methacrylic acid, and 6.7% by weight of itaconic acid and 6.3% by weight of aconitic acid (7) Preparation of Resin Microparticles Dispersion Composition A7

Resin microparticles dispersion composition A7 was prepared in the same procedure as Resin Microparticles Dispersion Composition A1, except that maleic acid having two carboxylic groups in a molecule was used in place of methacrylic acid. Content of vinyl type monomers used for forming the Resin Microparticles Dispersion Composition A7 was composed of 56% by weight of styrene, 24% by weight of n-butylacrylate and 20% by weight of itaconic acid and 63% by weight of maleic acid.

(8) Preparation of Resin Microparticles Dispersion Composition A8

Resin microparticles dispersion composition A8 was prepared in the same procedure as Resin Microparticles Dispersion Composition A1, except that fumaric acid having two carboxylic groups and aconitic acid having three carboxylic groups in a molecule were used in place of methacrylic acid. Adding amount of fumaric acid and aconitic acid in the first polymerization were each 36 parts, by weight and in the second polymerization were each 58 parts by weight. Content of vinyl type monomers used for forming the Resin Microparticles Dispersion Composition A8 was composed of 56% by weight of styrene, 24% by weight of n-butylacrylate and 10% by weight both of fumaric acid and aconitic acid.

(9) Preparation of Resin Microparticles Dispersion Composition A9

Resin microparticles dispersion composition A9 was prepared in the same procedure as Resin Microparticles Dispersion Composition A1, except that methacrylic acid was not used and adding amounts of styrene and n-butylacrylate were modified described below.

First Step Polymerization:

| | |
|---|---|
| Styrene | 247 parts by weight |
| n-Butylacrylate | 110 parts by weight |

Second Step Polymerization:

| | |
|---|---|
| Styrene | 390 parts by weight |
| n-Butylacrylate | 180 parts by weight |

Content of vinyl type monomers used for forming the Resin Microparticles Dispersion Composition A9 was composed of 69% by weight of styrene and 31% by weight of n-butylacrylate.

(10) Preparation of Resin Microparticles Dispersion Composition A10

Resin microparticles dispersion composition A10 was prepared in the same procedure as Resin Microparticles Dispersion Composition A1, except that adding amounts of the polymerizable monomers used in the first and second polymerization were modified, respectively, described below.

First Step Polymerization:

| | |
|---|---|
| Styrene | 269 parts by weight |
| n-Butylacrylate | 62 parts by weight |
| Methacrylic acid | 45 parts by weight |

Second Step Polymerization:

| | |
|---|---|
| Styrene | 402 parts by weight |
| n-Butylacrylate | 94 parts by weight |
| Methacrylic acid | 68 parts by weight |

Content of vinyl type monomers used for forming the Resin Microparticles Dispersion Composition A10 was composed of 71% by weight of styrene, 17% by weight of n-butylacrylate and 12% by weight of acrylic acid.

1-2. Preparation of Transparent Toner 1 Through 12

(1) Preparation of Transparent Toner 1

(a) Preparation of Transparent Toner Mother Particles 1

Into a reaction vessel equipped with a stirrer, thermosensor, cooling tube and nitrogen gas inlet the followings were put and stirred.

| | |
|---|---|
| Resin microparticles dispersion composition A1 (in terms of solid ingredient) | 450 parts by weight |
| Sodium plyoxyethylene-2-dodecyl ether sulfate | 2 parts by weight |
| Ion exchanged water | 900 parts by weight |

After adjusting the temperature inside of the reaction vessel at 25° C., 25% by weight of aqueous solution of sodium hydroxide was added to adjust pH of 10.

After that, an aqueous solution prepared by dissolving 70 parts by weight of magnesium chloride hexahydrate in 105 parts by weight of deionized water was added spending 30 minutes at 30° C. while stirring. After standing for 3 minutes, the temperature was raised by 85° C. spending 60 minutes, and the coagulation and fusion of the above particles were continued while keeping the temperature at 85° C. In such the state, the diameter of the particles obtained by the coagulation and fusion was measured by Multisizer 3, manufactured by Beckman Coulter Inc. The coagulation of the particles was stopped by adding an aqueous solution prepared by dissolving 73 parts by weight of sodium chloride in 290 parts by weight of deionized water when the volume based median diameter of the particles was reached to 5.5 μm.

After stop of the coagulation, the particles were ripened at a liquid temperature of 88° C. while heating and stirring, and the average circularity of the particles was measured by PPIA-2100, manufactured by Sysmex Corp. The fusing was continued until the average circularity reached to 0.960 to form Transparent Toner Mother Particle 1.

After that, the liquid temperature was cooled by 30° C. and the pH was adjusted to 2 by using hydrochloric acid, and then stirring was stopped.

The solid ingredient of the above prepared Transparent Toner Mother Particle Dispersion 1 was separated from the liquid ingredient by a basket type centrifuge separator Mark II 60×40, manufactured by Matsumoto Machine Mfg Co., Ltd., to prepare a wet cake of Transparent Toner Mother Particle 1.

The wet cake was washed by deionized water of 45° C. by using the foregoing centrifuge separator until the electric conductivity of the filtrate became to 5 μS/cm, and then transferred to Flash Jet Dryer, manufactured by Seishin Enterprise Co., Ltd., and dried until the moisture content was reduced by 0.5% by weight to prepare Transparent Toner Mother Particle 1.

(b) Addition of External Additives

The following external additives were added to the above prepared Transparent Toner Mother Particle 1 and treated by Henschel Mixer, manufactured by Mitsui Miike Mining Co., Ltd., to prepare Transparent Toner 1.

| | |
|---|---|
| Hexamethylsilazane-treated Silica (Average primary particle diameter: 12 nm) | 1.0 part by weight |
| n-Octylsilane-treated titanium dioxide (Average primary particle diameter 20 nm) | 0.3 parts by weight |

The treatment by Henschel mixer was carried out for 15 minutes at a circumference speed of the stirring wing of 35 msec and a treatment temperature of 35° C.

(2) Preparation of Transparent Toners 2 to 9

Transparent Toners 2 to 10 were prepared in the same manner as in Transparent Toner 1 except that Resin Microparticle Dispersion Composition A1 was each replaced by Resin Microparticle Dispersion composition A1 to A9, respectively.

(3) Preparation of Transparent Toner 10

Transparent Toner 10 was prepared by the same procedure as preparation of Transparent Toner 1 described above, except that Resin Microparticles Dispersion Composition to put into the reacting vessel was replaced by the followings.

| | |
|---|---|
| Resin microparticles dispersion composition A1 | 225 mass parts (in terms of solid ingredient) |
| Resin microparticles dispersion composition A4 | 225 mass parts (in terms of solid ingredient) |

(4) Preparation of Transparent Toner 11

The transparent toner disclosed in JP-A2002-341619 (Patent Document 3) was prepared by the following procedure referring to the description of Patent Document 3. Namely, the 100 parts by weight of polyester resin (linear polyester resin produced from terephthalic acid/adduct of bisphenol A and ethylene oxide/cyclohexane dimethanol in a mole ratio of 5:4:1) disclosed by Patent Document 3 was prepared, and it sufficiently mixed by Henschel Mixer, manufactured by Mitsui Miike Mining Co., Ltd., and melted and kneaded by a biaxial extruding kneader PCM-30, manufactured by Ikegai Corp., from which the taking out parts was detached, and then cooled.

The obtained kneaded material was cooled on a cooling belt and roughly crushed by a feather mill, and further crushed by a mechanical crusher TMK, manufactured by Kawasaki Heavy Industries Ltd., until the average particle diameter was made to 9 to 10 μm. Moreover the crushed material was powdered and roughly classified by a jet crusher IDS, manufactured by Nippon Pneumatic Mfg. Co., Ltd., until the average particle diameter was made to 5.5 μm. Transparent Toner Mother Particle 16 having a volume based median diameter of 5.5 μm was prepared from the above roughly classified powder by using a rotor type classifying apparatus (Teaplex type separator 100ATP manufactured by Hosokawa Micron Corp.).

The following external additives were added to the above prepared Transparent Toner Mother Particle 12 and treated by Henschel Mixer, manufactured by Mitsui Mile Mining Co., Ltd., to prepare Transparent Toner 12.

| | |
|---|---|
| Hexamethylsilazane-treated Silica (Average primary particle diameter 12 nm) | 1.0 part by weight |
| n-Octylsilane-treated titanium dioxide (Average primary particle diameter: 20 mn) | 0.3 parts by weight |

The treatment by Henschel mixer was carried out for 15 minutes at a circumference speed of the stirring wing of 35 msec and a treatment temperature of 35° C.

(5) Preparation of Transparent Toner 12

Transparent Toner 12 was prepared in the same manner as in Transparent Toner 1 except that Resin Microparticle Dispersion Composition A1 was replaced by Resin Microparticle Dispersion composition A10.

Transparent Toners 1 to 12 were prepared in the above manner.

2. Evaluation Experiment 2-1. Preparation of Transparent Toner Developers 1 to 12

Ferrite carrier coated with a methyl methacrylate resin having a volume average particle diameter of 40 μm was mixed with each of Transparent Toners 1 to 12 so as to make the transparent toner concentration of 6% by weight to prepare two-component Transparent Toner Developers 1 to 12.

2-2. Evaluation Experiment (1) Evaluation Conditions

Transparent Toners 1 to 12 were each charged into the glossing layer forming apparatus 1 shown in FIG. 1. The operating conditions of the glossing layer forming apparatus were set as later-mentioned for forming the transparent toner layer on the whole surface of the image support materials each carrying the same image printed by various image forming apparatuses available on the market. OK Top Coat+ Paper (weight: 157 g/m$^2$, thickness: 131 μm) manufactured by Oji Paper Co., Ltd. was used as the image support material. The following image forming apparatuses (a) to (c) available on the market were used for printing the images. Ten sheets of image support material for evaluation for each Transparent Toner were printed by each of the image forming apparatuses, and the glossing layer forming apparatus was continuously driven for 30 sheets in total. Solid image having reflective density of 1.6 was printed on the above described image support material by employing the image forming apparatus. The evaluation carried out by using the Transparent Toners 1 to 8 and 10, satisfying the constitution of the invention were each referred to as Examples 1 to 10, and that using Transparent Toners 9, 11 and 12 without the invention were each referred to as Comparative Examples 1 to 3, respectively.

The image forming apparatuses used for the evaluation were as follows:

(a) Electrophotographic system: bizhub C353CS (Konica Minolta Business Technologies Inc.)

(b) Ink jet system: Ink-jet Printer PX-5800 (Seiko Epson Corp)

(c) Press Work system: RISO Digital Screen plate making machine SP400D (Rico Kagaku Corp.)

In the course of continuous operation of the glossing layer forming apparatus 1, the printed matters were continuously supplied one by one to the glossing layer forming apparatus 1 so that the transparent toner layer was formed on each of the printed matters prepared by each of the image forming apparatuses. The description of "the printed matters prepared by each of the image forming apparatuses were continuously supplied one by one" means that, for example, the printed matters were lined in the order of the image of electrophotography→the image of ink-jet→the image of press work.

The conditions of glossing layer forming apparatus 1 shown in FIG. 1 were as follows:

(a) Transparent toner amount to be used for development: 4 g/m$^2$ (b) Material of the belt: Polyimide film (thickness: 50 μm) with PFA layer (thickness: 10 μm)

(c) Toughness of belt surface: 0.4 μm in Ra (d) Specification of heating and pressure roller Heating roller: Aluminum substrate having an outer diameter of 100 mm and a thickness of 10 min Pressure roller: Aluminum substrate having an outer diameter of 80 mm and a thickness of 10 mm covered with a silicone rubber layer of 3 mm Heat Source: A halogen lump was provided inside of each of the heating and pressure rollers and temperature was controlled by thermistor in each.

Nipping width between the heating roller and the pressure roller: 11 mm (e) Temperature of the heating roller and the pressure roller Surface temperature of the heating roller: 190° C.

Surface temperature of the pressure roller: 140° C.

(f) Temperature of the image support material at the position of the releasing roller: set at 505° C. fundamentally.

(g) Distance from the nipping portion to the position of releasing roller 620 mm (h) Transferring rate of the image support material: 120 mm/second (i) Transferring direction of the image support material: A3 size of image support material was transferred in the length direction.

(j) Evaluation environment: Ordinary temperature and humidity (20° C., 50% RH) and high temperature and high humidity (33° C., 80% RH).

(2) Evaluation Experiment

The evaluation was conducted hr the following manner. Calculation of critical surface tension and measurement of glossiness were at first conducted in ordinary temperature and ordinary humidity environment as for the printed matter on which glossing layer was fanned at around 30th sheets by the manner described above via a glossing layer forming apparatus of FIG. 1. Subsequently, measured printed matter was moved in high temperature and high humidity environment and fingerprint visibility was evaluated. Evaluation procedure of each evaluation item is described below.

Calculation Critical Surface Tension

Under the condition of ordinary temperature and ordinary humidity environment (20° C., 50% RH), 0.3 mg of pure water and oleic acid were each dripped on a glossy surface of the printed matter described above, and 5 seconds after dripping, contact angle of the formed droplet was measured by employing contact angle meter CA-DT (manufactured by Kyowa Interface Science Co., Ltd.) obtained from the market. The measured values thus obtained were plotted (Zisman Plot) to form a chart. The critical surface tension was obtained by extrapolating contact angle being 0 in the chart. The samples having critical surface tension of 50 mN/m or more were classified as acceptable.

Measurement of Glossiness

Glossiness of the glossing layer formed on the printed matter described above was measured and evaluated under ordinary temperature and ordinary humidity environment (20° C., 50% RH) by employing a glossimeter GMX-203, manufactured by Murakami Color Research Laboratory Co., Ltd. having constitution illustrated in FIG. 2. It was conducted in accordance with JIS Z8741 1983 Method 2 described above wherein measurement angle, i.e., angle shown by θ in FIG. 2 (measurement angle) was set as 20°. Evaluation was conducted by employing a printed matter of glossiness. The samples having glossiness of 60 or more were classified as acceptable, and 80 or more were classified particularly excellent Evaluation of Fingerprint Visibility Fingerprint was stuck on the printed matter having been subjected to measurement of glossiness described above under the condition of high temperature and high humidity environment (33° C., 80% RH), and light from light source of white fluorescent lamp was irradiated at a finger print stuck portion. Irradiation was conducted with varying incident angle, and evaluation was conducted by asking incident angle at which the finger print was confirmed by eye viewing. In this instance when the finger print is difficult to remarkable, the incident angle becomes large. The samples having incident angle of 60° or larger was classified as acceptable.

The result is summarized in Table 1.

TABLE 1

| | | Electrophotographic image | | | Ink-jet image | | | Press work image | | |
|---|---|---|---|---|---|---|---|---|---|---|
| | Transparent Toner No. | Critical surface tension (mN/m) | Glossiness | Finger print visibility (°) | Critical surface tension (mN/m) | Glossiness | Finger print visibility (°) | Critical surface tension (mN/m) | Glossiness | Finger print visibility (°) |
| Example 1 | 1 | 55 | 92 | 70 | 55 | 92 | 70 | 55 | 93 | 70 |
| Example 2 | 2 | 53 | 90 | 65 | 53 | 91 | 67 | 53 | 91 | 66 |
| Example 3 | 3 | 57 | 93 | 70 | 57 | 92 | 71 | 57 | 93 | 71 |
| Example 4 | 4 | 63 | 90 | 63 | 63 | 91 | 63 | 63 | 91 | 64 |
| Example 5 | 5 | 50 | 91 | 60 | 50 | 92 | 60 | 50 | 90 | 60 |
| Example 6 | 6 | 56 | 92 | 68 | 56 | 92 | 68 | 56 | 93 | 68 |
| Example 7 | 7 | 55 | 93 | 69 | 55 | 92 | 69 | 55 | 93 | 69 |
| Example 8 | 8 | 57 | 91 | 71 | 57 | 92 | 71 | 57 | 93 | 71 |
| Example 9 | 9 | 53 | 91 | 64 | 53 | 92 | 64 | 53 | 93 | 64 |
| Example 10 | 11 | 60 | 92 | 65 | 60 | 93 | 66 | 60 | 92 | 66 |
| Comparative Example 1 | 10 | 43 | 80 | 40 | 43 | 79 | 40 | 43 | 79 | 40 |
| Comparative Example 2 | 12 | 42 | 77 | 38 | 42 | 76 | 38 | 42 | 76 | 38 |

Examples 1 to 10 using transparent toner which forms a glossy layer having critical surface tension of 50 mN/m or more at 20° C. were confirmed to obtain good glossiness and finger visibility as shown in FIG. 1. It was confirmed that a printed matter with beautiful finished image without damaging a beauty of glossy surface could be obtained even when finger print was stick by touching the glossy surface formed on whole surface of the image support material with naked hand in the Examples 1 to 10. The formed glossy layer had a level of reflecting the image clearly.

Comparative Examples 1 and 2 using transparent toner which forms a glossy layer having critical surface tension of not more than 50 mN/m at 20° C. were confirmed that the finger prints visibility was markedly inferior to Examples 1 to 10. The samples on which finger prints stuck by touching with naked hands deteriorated beautiful finished image with remarkable finger prints.

The invention claimed is:

1. An image forming method comprising at least steps of heating and melting a transparent toner supplied on an image support material;

bringing the image support material, at a side on which the transparent toner is supplied, into contact with a belt;

cooling the transparent toner while in contact with the belt; and releasing the image support material from the belt to form a glossy surface, wherein the transparent toner comprises a resin composed of a polymer formed by at least a polymerizable monomer containing a carboxylic group (—COOH), styrene, and an acrylic ester derivative or a methacrylic ester derivative, a content ratio of the polymerizable monomer containing the carboxylic group in the polymer is 15% by mass or more, and the glossy surface formed by the transparent toner has a critical surface tension, at 20° C., of at least 50 mN/m.

2. The image forming method of claim 1, wherein the resin has a number average molecular weight Mn of 5,000 to 50,000 and a ratio of weight average molecular weight Mw to number average molecular weight Mn (Mw/Mn) of 1.0 to 1.5.

3. The image forming method of claim 1 wherein, the resin is formed by at least the polymerizable monomer having a carboxylic group (—COOH), styrene, and the acrylic ester derivative.

4. The image forming method of claim 1 wherein the polymerizable monomer has two or more carboxylic groups.

* * * * *